US008402902B2

(12) United States Patent
Kutscher et al.

(10) Patent No.: US 8,402,902 B2
(45) Date of Patent: Mar. 26, 2013

(54) APPARATUS FOR THE MANUFACTURE OF MATTRESS PLATES

(75) Inventors: Thomas Kutscher, Altenburg (DE); Frank Rattay, Altenburg (DE)

(73) Assignee: KSA GmbH & Co. KG, Altenburg (DE)

( * ) Notice: Subject to any disclaimer, the term of this patent is extended or adjusted under 35 U.S.C. 154(b) by 60 days.

(21) Appl. No.: 13/033,050

(22) Filed: Feb. 23, 2011

(65) Prior Publication Data

US 2011/0203503 A1 Aug. 25, 2011

(30) Foreign Application Priority Data

Feb. 24, 2010 (DE) ..... 10 2010 009 013

(51) Int. Cl.
*D05B 11/00* (2006.01)

(52) U.S. Cl. ..... 112/2.1

(58) Field of Classification Search ..... 112/117, 112/470.01, 170.12, 170.13, 118, 155, 220, 112/221, 2.1, 2.2, 2
See application file for complete search history.

(56) References Cited

U.S. PATENT DOCUMENTS 6,178,903 B1 * 1/2001 Bondanza et al. ..... 112/117
7,191,718 B1 3/2007 Myers et al.
7,552,691 B1 * 6/2009 Martelli et al. ..... 112/475.08
7,597,059 B2 * 10/2009 Stutznacker ..... 112/475.08

FOREIGN PATENT DOCUMENTS

DE 691 12 467 T2 3/1996

* cited by examiner

*Primary Examiner* — Danny Worrell
(74) *Attorney, Agent, or Firm* — McCormick, Paulding & Huber LLP

(57) ABSTRACT

An apparatus for the production of rectangular mattress plates from a length of material includes a base frame, a feed drive for feeding the length of material in a transport direction (A), two lateral sewing stations, each provided with a longitudinal sewing head for producing a lateral seam and with a longitudinal cutter, a transverse sewing station provided with a transverse sewing head and a transverse cutter that can be moved along a crossbeam, and a control device for controlling the feed drive, the transverse drive, the lateral sewing stations, and the transverse sewing station. The lateral sewing stations are each pivotable by a rotary drive about an axis extending perpendicularly with regard to the plane of a transport path of the material and moveable along crossbeams by a translatory drive. The translatory drive and the rotary drive are controllable by the control device in coordination with the feed drive.

3 Claims, 2 Drawing Sheets

APPARATUS FOR THE MANUFACTURE OF MATTRESS PLATES

CROSS REFERENCE TO RELATED APPLICATION

Applicants hereby claim foreign priority benefits under U.S.C. §119 from German Patent Application No. 10 2010 009 013.1 filed on Feb. 24, 2010, the contents of which are incorporated by reference herein.

FIELD OF THE INVENTION

The invention concerns an apparatus for the manufacture of at least approximately rectangular mattress plates from a length of material which is continuously fed to said apparatus, the apparatus including a base frame with a transport path for the length of material, a feed drive for feeding the length of material in a transport direction, two lateral stitching stations which are arranged at a variable distance from each other on a crossbar of the base frame extending transversely across the transport path and which are each provided with a longitudinal sewing head for producing a lateral seam as well as with a longitudinal cutter, a transverse sewing station which is arranged on a crossbar of the base frame extending transversely with regard to the transport direction across the width of the transport path such that it can be moved along said crossbar and which is provided with a transverse sewing head as well as with a transverse cutter, a transverse drive for driving the transverse sewing station perpendicularly with regard to the transport direction, and a control device for controlling the feeding drive, the transverse drive, and the functioning of the lateral and transverse sewing stations.

BACKGROUND OF THE INVENTION

An apparatus of the kind described above is known in practise. It allows the manufacture of mattress plates from a pre-quilted web which is fed continuously to the apparatus. Two such mattress plates are then connected by means of a circumferential material band known as border in order to form a mattress cover.

The mattress plates which can be produced by means of an apparatus of the kind described above are of rectangular shape with acute corners, since the mattresses used in Europe are usually placed inside a rectangular bed frame and are supposed to essentially fill this frame. However beds in other countries, such as the USA, have a different design. American beds usually include a bed frame which is provided with a wooden floor instead of a slatted frame as it is normally used in European beds. Onto this wooden floor a so-called spring box is placed, on which spring box the actual mattress lies. The spring box contains springs which serve to provide resilience and support to the mattress and thus fulfill the function of the slatted frame common in Europe. Since in this case the mattress is exposed, it is usually provided with rounded corners. Up to now it has not been possible to produce rectangular mattress plates with rounded corners by means of an apparatus of the kind described above.

SUMMARY OF THE INVENTION

It is an object of the invention to disclose an apparatus of the kind described in the introduction which can be used also to manufacture rectangular mattress plates with rounded corners and arbitrary dimensions without the need to retool the apparatus in correspondence with the different measurements.

This object is solved according to the invention in that the lateral sewing stations are each pivotable by means of a rotary drive about an axis extending perpendicularly with regard to the transport path plane, and adjustable along their respective crossbeam by means of a translatory drive, and in that the translatory drive and the rotary drive are controllable by means of the control device in coordination with the feeding drive for the length of material.

With the solution according to the invention it is now possible to not only sew and cut in parallel and perpendicularly to the transport direction, as it was before, but to also guide the lateral sewing stations along curves having a freely selectable radius by rotating and translating the lateral sewing stations while adjusting the feed rate of the length of material. By means of this feature it is possible to produce basically rectangular mattress plates with rounded corners from a continuously fed length of material. Moreover, it is possible to sew and cut mattress plates having different dimensions in arbitrary sequence without the need to stop and retool the apparatus. Thus also small batches of mattress plates with different dimensions and shapes can be produced in an efficient manner without offcuts.

It is advantageous to design the sewing heads of the lateral sewing stations as two-needle machines for producing a two-needle seam, which is known as such, while the respective longitudinal cutter is arranged such that the cutting contour is to one side of the two-needle seam. The sewing head of the transverse sewing station is advantageously designed as a four-needle machine for producing two parallel two-needle seams, while the transverse cutter is arranged such that the cutting contour runs between the two two-needle seams.

BRIEF DESCRIPTION OF THE DRAWINGS

The following description in connection with the annexed drawing explains the invention by means of an exemplary embodiment. In the drawing.

DETAILED DESCRIPTION OF THE PREFERRED EMBODIMENTS

Figure 1:
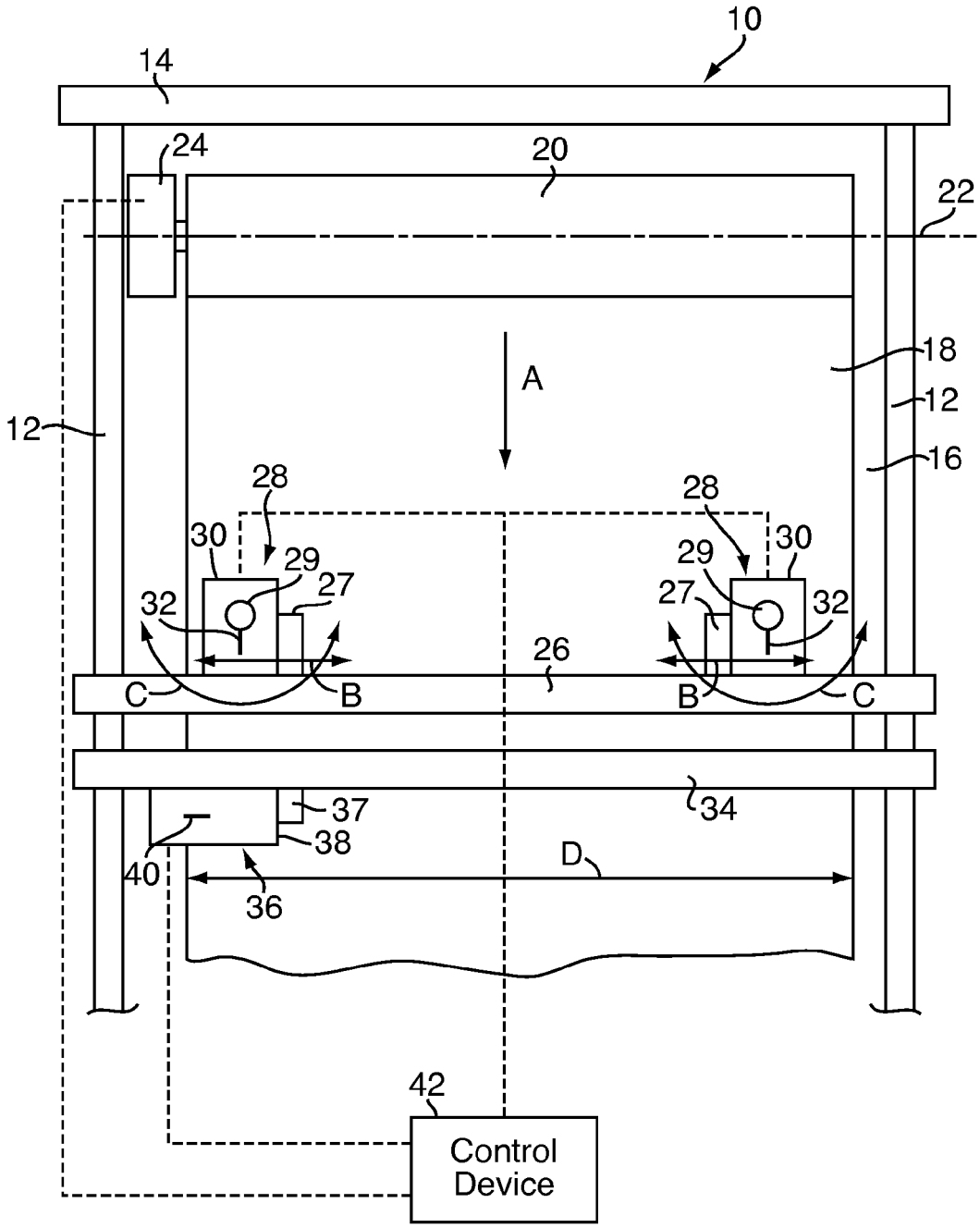
FIG. 1 shows a schematic plan view illustrating the design of the apparatus according to the invention.

The apparatus for producing mattress plates as schematically depicted in FIG. 1 includes a base frame 10 in the shape of a rectangular machine frame with side beams 12 and a crossbeam 14. Between the side beams 12 a transport path 16 for a length of material 18 extends which length of material is pulled off a supply roller 20 in a transport direction indicated by the arrow A. The supply roller 20 is mounted rotatably on the base frame 10 about a rotary axis 22 perpendicular to the side beams 12. The means to pull off and support the length of material 18 are represented as a whole by a feed drive 24. A detailed description can be dispensed with since the means for feeding the length of material 18 are known as such.

A first crossbeam 26 extends transversely across the transport path 16 between the side beams 12 on which crossbeam two lateral sewing stations 28 are arranged which can each be moved by means of a schematically depicted adjusting drive 27 in the direction of the double arrow B and which are each mounted such that they are pivotable about a rotary axis perpendicular to the transport path 16 in the direction of the double arrow C by means of a rotary drive 29. Each lateral sewing station 28 includes a sewing head 30 in the form of a two-needle chain-stitching machine which is not depicted in greater detail, as well as a longitudinal cutter 32 symbolized by a line-shaped knife.

On a second crossbeam 34 extending in parallel to the first crossbeam 26 a transverse sewing station 36 is arranged which is moveable by means of a transverse drive 37 in the direction of the double arrow D transversely across the transport path 16. The transverse sewing station 36 includes a sewing head 38 in the form of a four-needle chain-stitching machine and a transverse cutter 40 symbolized by a line-shaped knife. The depiction of the machine design is merely schematic. The supply roller and the two crossbeams can also be arranged on separate frames instead of on a base frame with long lateral beams 12.

Figure 2:
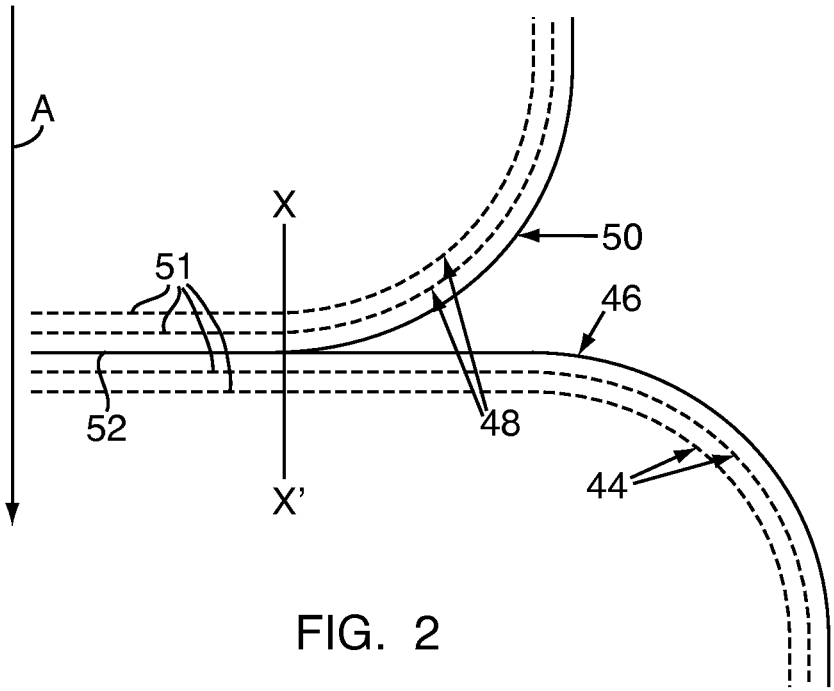
FIG. 2 shows a schematic depiction of the corner areas of two subsequent mattress plates to illustrate the mode of operation of the apparatus according to the invention.

The sewing heads, cutting devices and adjustment and rotary drives of the lateral sewing stations 28 and of the transverse sewing station 36 as well as the feed drive 24 for the length of material 18 are controllable via a common control device 42, as indicated by means of dashed lines. The operations which are programmable in the control device in advance will now be explained in more detail with reference to FIG. 2.

In FIG. 2 the arrow A again indicates the transport direction in which the length of material serving as the base material for the production of the mattress plates is moved along the transport path. In a first work phase a two-line seam 44 is produced by means of the sewing head 30 and at the same time the fringe of the cloth is cut off by means of the longitudinal cutter 32 along the cutting contour 46 running to the right of the double seam 44 at a distance of 2 to 3 mm from the double seam. For producing the course of the seam 44 and the cutting contour 46 the control device 42 has to control the feed drive 24 for the length of cloth 18 as well as the adjustment drive 27 and the rotary drive 29 for the lateral sewing station 28 such that at the same time a movement of the length of cloth 18 in the transport direction A, a translatory movement of the lateral sewing station 28 along the crossbeam 26 to the left in FIG. 2, and a rotation of the lateral sewing station 28 to the left in FIG. 2 takes place. These three movements take place in a synchronized manner until the lateral sewing station 28 reaches the line XX'. Here the lateral sewing station 28 is stopped. With this the first working phase is terminated.

In a second working phase the lateral sewing station 28 is lifted off the length of cloth in its position at the line XX', turned about by 180° and lowered down again at the line XX' so that the longitudinal cutter 32 is set down on the cutting contour 46. Subsequently the double seam 48 and the cutting contour 50 are produced whereby the control is carried out again such that the length of cloth 18 is moved in the transport direction A, while the lateral sewing station 28 rotates to the left in FIG. 2 and is moved to the right along the crossbeam 26 until it reaches the right lateral edge of the top mattress plate in FIG. 2. Of course the other lateral sewing station performs a symmetrical movement in the opposite direction.

When due to the further movement of the length of cloth in the transport direction A the meeting point of the two cutting contours 46 and 50 of working phases 1 and 2 reaches the second crossbeam with the transverse sewing station 36, all drives are stopped. In a third working phase the transverse sewing station is moved from a waiting position and lowered down onto the line XX' such that the transverse cutter is lowered down exactly onto the meeting point of the two cutting contours 46 and 50 from working phases 1 and 2. Now the sewing head 38 of the transverse sewing station 36 sews a four-stitch seam 51 continuing the two double seams 44 and 48 transversely across the stationary length of cloth 18 until it reaches the corresponding line XX' close to the left edge of the length of cloth. At the same time the transverse cutter 40 cuts through the length of cloth 18 in a cutting line 52 continuing the cutting contours 46 and 50. After it reaches the left line XX' the sewing head 38 of the transverse sewing station 36 sews further for a short distance outside the length of cloth 18 until also the transverse cutter 40 reaches the left line XX'. The sewing stitch chains created thereby between the outer edge of the length of cloth 18 and the sewing head 38 of the transverse sewing station 36 are then severed by means of a threat severing device not depicted in the drawing. Subsequently the transverse sewing station 36 is lifted off the length of cloth 18 and moved back into its waiting position. Then the sewing process is continued for the top mattress plate in FIG. 2.

Figure 3:
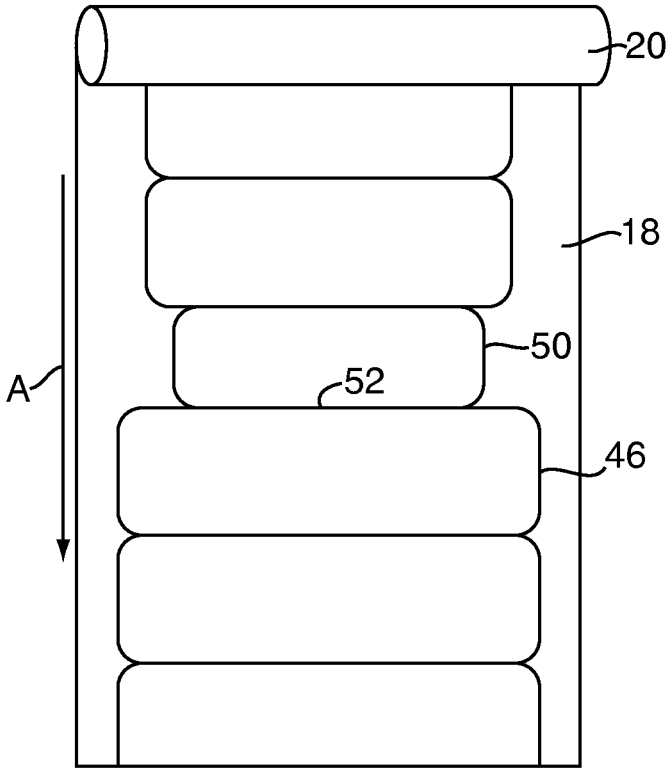
FIG. 3 shows a schematic plan view onto a length of material with a sequence of mattress plates having different dimensions being produced form the length of material.

FIG. 3 shows how the solution according to the invention enables the production of mattress plates having different dimensions with rounded corners (or alternatively with acute corners) in direct sequence form a continuously fed length of cloth. Hereby retooling times for adjusting the apparatus in accordance with the various dimensions of the mattress plates as well as the additional material cut-offs normally caused by such retooling are avoided. Thus the apparatus according to the invention is suited also for producing small batches to order. At the same time productivity is increased.

While the present invention has been illustrated and described with respect to a particular embodiment thereof, it should be appreciated by those of ordinary skill in the art that various modifications to this invention may be made without departing from the spirit and scope of the present invention.

What is claimed is:

1. An apparatus for the production of at least approximately rectangular mattress plates from a length of material which is continuously fed to the apparatus, the apparatus including a base frame with a transport path for the length of material, a feed drive for feeding the length of material in a transport direction (A), two lateral sewing stations which are arranged at an adjustable distance from each other on a crossbeam of the base frame directed transversely across the transport path and which are each provided with a longitudinal sewing head for producing a lateral seam and with a longitudinal cutter, a transverse sewing station which is arranged on a crossbeam of the base frame directed transversely with regard to the transport direction (A) across the width of the transport path such that the transverse sewing station can be moved along said crossbeam and which is provided with a transverse sewing head as well as a transverse cutter, a transverse drive for moving the transverse sewing station, and a control device for controlling the feed drive, the transverse drive, the lateral sewing stations, and the transverse sewing station, wherein the lateral sewing stations are each pivotable by means of a rotary drive about an axis extending perpendicularly with regard to the plane of the transport path and moveable along their crossbeams by means of a translatory drive and in that the translatory drive and the rotary drive are controllable by means of the control device in coordination with the feed drive for the length of material.

2. The apparatus according to claim 1, wherein the sewing heads of the lateral sewing stations are designed as two-needle machines for producing a double seam, and the corresponding longitudinal cutters are designed for producing a cut along a cutting path, each said longitudinal cutter being arranged such that the cutting path runs to one side of the double seam produced by the respective lateral sewing station.

3. The apparatus according to claim 1, wherein the sewing head of the transverse sewing station is designed as a four-needle machine for producing two parallel double seams, and the transverse cutter is designed for producing a cut along a cutting path, said transverse cutter being arranged such that the cutting path runs between the two double seams produced by the transverse sewing station.

* * * * *